US012535247B2

(12) United States Patent
Alldritt

(10) Patent No.: US 12,535,247 B2
(45) Date of Patent: Jan. 27, 2026

(54) SYSTEM AND METHOD FOR CIRCULATING GAS FOR A DILUTION REFRIGERATOR

(71) Applicant: Bluefors Oy, Helsinki (FI)

(72) Inventor: Benjamin Alldritt, Helsinki (FI)

(73) Assignee: BLUEFORS OY, Helsinki (FI)

( * ) Notice: Subject to any disclaimer, the term of this patent is extended or adjusted under 35 U.S.C. 154(b) by 0 days.

(21) Appl. No.: 19/231,886

(22) Filed: Jun. 9, 2025

(65) Prior Publication Data

US 2026/0002705 A1 Jan. 1, 2026

(51) Int. Cl.
*F25B 9/12* (2006.01)
*F25B 9/14* (2006.01)

(52) U.S. Cl.
CPC ..... *F25B 9/12* (2013.01); *F25B 9/145* (2013.01)

(58) Field of Classification Search
CPC ..... F25B 9/10; F25B 9/145; F25B 9/12
See application file for complete search history.

(56) References Cited

U.S. PATENT DOCUMENTS

| | | | |
|---|---|---|---|
| 8,464,542 B2 | 6/2013 | Hilton et al. | |
| 2023/0135323 A1 | 5/2023 | Jette et al. | |
| 2025/0129974 A1* | 4/2025 | Huneault | F25B 9/12 |

FOREIGN PATENT DOCUMENTS

WO 2023147671 A1 8/2023

OTHER PUBLICATIONS

Jefferson Lab's , Dilution Refrigerator Operations, Aug. 4, 2016 (Year: 2016).*
Extended European Search Report issued by the European Patent Office in relation to European Patent Application No. 24185409.0 dated Dec. 2, 2024 (8 pages).
Shvarts Vet al: "Custom designed UHV compatible He-3 cryostats", Journal of Physics: Conference Series, Institute of Physics Publishing, Bristol, GB, vol. 150, No. 1, Feb. 1, 2009, p. 12047, XP020155624, ISSN: 1742-6596, DOI: 10.1088/1742-6596/150/1 /012047.
Graham Batey and Gustav Teleberg, "Principles of dilution refrigeration", Oxford Instruments NanoScience Tools Limited, 2015, (20 pages) including cover sheet.

* cited by examiner

*Primary Examiner* — Frantz F Jules
*Assistant Examiner* — Webeshet Mengesha
(74) *Attorney, Agent, or Firm* — Robert P. Michal, Esq.; Rimon PC

(57) ABSTRACT

Disclosed is a gas handling system (GHS) for a dilution refrigerator, the GHS including a primary pump unit arranged for maintaining a helium output flow including helium vapor from the dilution refrigerator and a helium input flow into the dilution refrigerator for maintaining a cooled operating temperature of the dilution refrigerator. The primary pump unit is arranged for facilitating initiating the helium input flow and the helium output flow for cooling the dilution refrigerator by both capturing the helium vapor from the dilution refrigerator and causing the helium vapor to be condensed for the helium input flow at the dilution refrigerator.

16 Claims, 2 Drawing Sheets

SYSTEM AND METHOD FOR CIRCULATING GAS FOR A DILUTION REFRIGERATOR

CROSS-REFERENCE TO RELATED APPLICATIONS

This application claims priority to European Patent Application No. 24185409.0 filed Jun. 28, 2024, the disclosure of this application is expressly incorporated herein by reference in its entirety.

FIELD

The present invention relates to gas circulation for a dilution refrigerator.

BACKGROUND

A dilution refrigerator, which may here refer to a helium-3 (He-3)/helium-4 (He-4) dilution refrigerator in particular, is a cryogenic device that can provide continuous cooling at temperatures below 1 Kelvin, for example to a temperature of 10-100 mK or below. For operation, the dilution refrigerator requires gas circulation for circulating helium through the dilution refrigerator. Helium gas handling systems for dilution refrigerators are typically designed around a common platform: a turbopump, a backing pump, and a compressor for helium mixture circulation. The typical design poses fundamental limitations to the performance of the system.

The existing solutions have been utilized for over a decade to create the necessary flow condition for a dilution refrigerator. Improving performance has typically been by increasing the number of turbopumps as well as increasing the size of the backing pump, but this is both costly and increases the size of the gas handling system considerably. There is no scalable product available for future demand of larger cooling powers. Additional turbopumps yield minimal improvement in system performance and they are costly, heavy and challenging to install. Moreover, a challenge is posed by the complexity of the gas handling systems, creating problems for assembly, testing, and installation.

SUMMARY

According to a first aspect, a gas handling system (GHS) for a dilution refrigerator is disclosed. The GHS comprises a primary pump unit, which can be arranged for maintaining a helium output flow comprising helium vapor from the dilution refrigerator and a helium input flow into the dilution refrigerator for maintaining a cooled operating temperature of the dilution refrigerator. Importantly, the primary pump unit can be arranged not only for maintaining said flows but also for facilitating initiating the helium input flow and the helium output flow for cooling the dilution refrigerator by both capturing the helium vapor from the dilution refrigerator and causing the helium vapor to be condensed for the helium input flow at the dilution refrigerator.

This solution involves both initiating and maintaining circulation of helium through the dilution refrigerator by the GHS and utilizing the primary pump unit in particular. It allows disposing of solutions such as secondary pump units required to separately start the circulation. In contrast, the GHS as disclosed can initiate helium circulation through the dilution refrigerator by capturing helium, in particular He-3, from the dilution refrigerator as helium vapor, circulating the helium back to the dilution refrigerator so that it is condensed there by the pressure generated by the primary pump unit.

The solution allows streamlining the gas handling system as a single pump unit, i.e., the primary pump unit, may replace all of the following: one or more turbopumps for pumping helium from the dilution refrigerator, a scroll pump for pumping helium into the dilution refrigerator and a compressor for facilitating condensation of the helium vapor. In particular, no compressors are required in the GHS since the primary pump unit can cause the helium vapor to be condensed for the helium input flow at the dilution refrigerator by providing the pressure for condensing the helium vapor with one or more pumps of the primary pump unit, and this can be done also for initiating the helium input flow and the helium output flow, not only for maintaining said flows.

The GHS as disclosed is no longer limited by the turbopump-centered design. Instead of using multiple pumps to separately initiate the helium flows and facilitate condensation of the helium vapor, a single primary pump unit, even of a single pump, may be used. The primary pump unit, even with a single pump, may replace three turbo pumps, a scroll pump and a compressor. The primary pump unit allows an increased helium pressure to cause condensation of the helium vapor for the helium input flow at the dilution refrigerator.

In an embodiment, the primary pump unit has a housing that forms an outer surface of the primary pump unit. This allows a compact solution where one or more pumps of the primary pump unit may be structurally joined as an integrated unit.

In an embodiment, the primary pump unit comprises one or more Roots pumps arranged for facilitating initiating the helium input flow and the helium output flow by both capturing the helium vapor from the dilution refrigerator and causing the helium vapor to be condensed. Roots pumps have been found to be able to not only initiate the helium input flow and the helium output flow but also to maintain said flows at an elevated level. The one or more Roots pumps may subsequently also handle the maintaining of the helium input flow and the helium output flow. This solution allows using a completely new type of pump to handle pressures and flow conditions currently unreachable in modern gas handling systems for dilution refrigerators. In addition, the total solution can be made both smaller and less expensive. The solution also allows quiet, clean and increased helium flow.

In an embodiment, the one or more Roots pumps comprises a multi-stage Roots pump, which can allow yet improved flow levels, thereby improving the performance of the dilution refrigerator.

In an embodiment, the one or more Roots pumps comprises a single-stage Roots pump arranged upstream of the multi-stage Roots pump. The single-stage Roots pump can have a larger mechanical support structure than the mechanical support structure of any of the stages of the multi-stage Roots pump, thereby allowing a larger volume to be pumped therethrough and thus allowing a larger pressure or pressure difference over the single-stage Roots pump than any of the stages of the multi-stage Roots pump. The single-stage Roots pump can thus improve the capture of the helium vapor to create an optimized initial pressure for the multi-stage Roots-pump. The multi-stage Roots pump can, together with the single-stage Roots pump, mitigate or eliminate the design issues following from combining a turbo pump and a scroll pump, prolong the lifetime of the GHS and increase the helium input flow and the helium output flow.

In an embodiment, the multi-stage Roots pump comprises five or more pumping stages. This has been found to provide optimized helium flow in various situations.

In an embodiment, the GHS comprises an auxiliary pump unit, such as a system pump. The auxiliary pump unit can be separable from the primary pump unit through one or more valves. While the auxiliary pump unit is not required for providing sufficient pressure for initiating the helium input flow and/or the helium output flow, as this can be handled by the primary pump unit in accordance of the invention, the GHS can be arranged to use the auxiliary pump unit for maintaining the helium input flow and the helium output flow, e.g. as a backup pump unit for the primary pump unit. For this purpose, the auxiliary pump unit may comprise one or more multi-stage Roots pumps for maintaining the helium output flow and the helium input flow for maintaining the cooled operating temperature of the dilution refrigerator when the helium vapor is routed through the auxiliary pump unit through the one or more valves. The auxiliary pump unit allows maintaining low temperatures, for example in service situations, in the dilution refrigerator.

In an embodiment, the GHS comprises a control system for adjusting a rotation rate of one or more pumps, in particular multi-stage Roots pumps, of the primary pump unit. This allows adjusting the flow rate of the helium input flow and/or the helium output flow directly at the primary pump unit. The rotation rate of the one or more pumps may be dynamically controlled.

In an embodiment, the GHS is arranged to circulate helium from the helium output flow to the helium input flow without purification. The use of the primary pump unit for capturing, circulating and causing condensing of helium allow the GHS to be constructed without any traps and/or filters that are used for purification of the helium from impurities. For this purpose, the housing of the primary pump unit and/or the dilution refrigerator(s), e.g. the joints thereof, may be metal sealed. No rubber O-rings are needed.

In an embodiment, the GHS is arranged to increase the helium input flow into the dilution refrigerator and/or the helium output flow from the dilution refrigerator to 5 mmol/s or more, e.g. above 20 mmol/s, with the primary pump unit. This allows improved cooling of the dilution refrigerator. The measured helium flow may comprise or consist of He-3 but possibly also of He-4.

In an embodiment, the primary pump unit comprises at least two pumps in parallel for facilitating initiating the helium input flow and the helium output flow for cooling the dilution refrigerator, the at least two pumps capturing the helium vapor in parallel. This allows increasing the helium input flow and the helium output flow and thus improving cooling of the dilution refrigerator. In an embodiment, the at least two pumps in parallel are multi-stage Roots pumps.

In an embodiment, the capturing the helium vapor from the dilution refrigerator is performed at a pressure of 0.3 mbar or less for a molar flow of 2 mmol/s or more. The GHS and the primary pump unit can be arranged to provide said pressure and said molar flow for the helium vapor as it enters the GHS from the dilution refrigerator.

In an embodiment, the GHS, or the primary pump system in particular, is arranged to provide an output pressure of 0.5 bar or more for the helium vapor to cause the helium vapor to be condensed for the helium input flow at the dilution refrigerator.

According to a second aspect, a cryogenic cooling system is disclosed. The cryogenic cooling system comprises one or more dilution refrigerators. The cryogenic cooling system also comprises the gas handling system according to the first aspect or its embodiments in any combination, arranged to facilitate, by the primary pump unit, initiating a helium input flow into each of the one or more dilution refrigerators and a helium output flow, comprising helium vapor, from each of the one or more dilution refrigerators for cooling the one or more dilution refrigerators by both capturing the helium vapor from the corresponding dilution refrigerator of the one or more dilution refrigerators and causing the helium vapor to be condensed for the helium input flow at the corresponding dilution refrigerator of the one or more dilution refrigerators.

According to a third aspect, a method for gas handling for a dilution refrigerator is disclosed. The method comprises facilitating a helium input flow into the dilution refrigerator and a helium output flow comprising helium vapor from the dilution refrigerator for cooling the dilution refrigerator by both capturing the helium vapor from the dilution refrigerator and causing the helium vapor to be condensed for the helium input flow at the dilution refrigerator with a primary pump unit. For the method the cryogenic cooling system according to the second aspect or the GHS according to the first aspect, or their embodiments in any combination, may be used.

Cooling power of the dilution refrigerator can be directly related to flow of helium, in particular He-3, in the GHS. An increase in flow, with an appropriate dilution refrigerator, can achieve significantly higher cooling powers than currently available. Increasing flow by increasing turbopumps can only yield diminishing returns as turbopumps are limited by inlet pressure. Continued operation at higher inlet pressures can result in decaying performance or catastrophic failure of the turbopump. In any case, lower pumping efficiency than less expensive, conventional pumps is produced.

The disclosed solutions can be utilized to cool both large and small cryostat systems. Additionally, the power of the pump(s) of the primary pump unit can be adjusted such that dilution refrigerators designed for smaller flow can benefit without high power consumption of the pump, while high-flow units can benefit from the maximum pump power.

In the disclosed solutions, turbopumps are not needed. The number of components of the GHS can be reduced to focus on circulation performance. The design of the GHS may be simplified, and the number of product variants reduced. In addition, the labor time for manufacturing and maintenance on the field may be reduced.

With the disclosed solutions, a single pump such as a multi-stage Roots pump at the primary pump unit may replace, for example, three turbo pumps. The pump(s) of the primary pump unit can be operated with variable rotation rate (or RPM), for example depending on operating mode (e.g. condense, low flow, high flow, recover). The primary pump unit may comprise a single-stage Roots pump to support high flow. It allows, by design, operation in high-pressure, continuous flow environments and is mechanically simple. The auxiliary pump unit may comprise or consist of a multi-stage Roots pump as a low-pressure backing pump.

Roots pumps are vacuum-friendly in that they are non-contact and therefore do not generate particles, while for example scroll pumps, oil pumps or diaphragm pumps do generate particles. This allows them to be used without filters for the GHS. Roots pumps can be provided as non-contact pumps, which do not regenerate particles unlike scroll pumps, oil pumps or diaphragm pumps.

It is to be understood that the aspects and embodiments described above may be used in any combination with each other. Several of the aspects and embodiments may be combined together to form a further embodiment of the invention.

BRIEF DESCRIPTION OF THE DRAWINGS

The accompanying drawings, which are included to provide a further understanding and constitute a part of this specification, illustrate examples and together with the description help to explain the principles of the disclosure. In the drawings.

Like references are used to designate equivalent or at least functionally equivalent parts in the accompanying drawings.

DETAILED DESCRIPTION

The detailed description provided below in connection with the appended drawings is intended as a description of examples and is not intended to represent the only forms in which the example may be constructed or utilized. However, the same or equivalent functions and structures may be accomplished by different examples.

Figure 1:
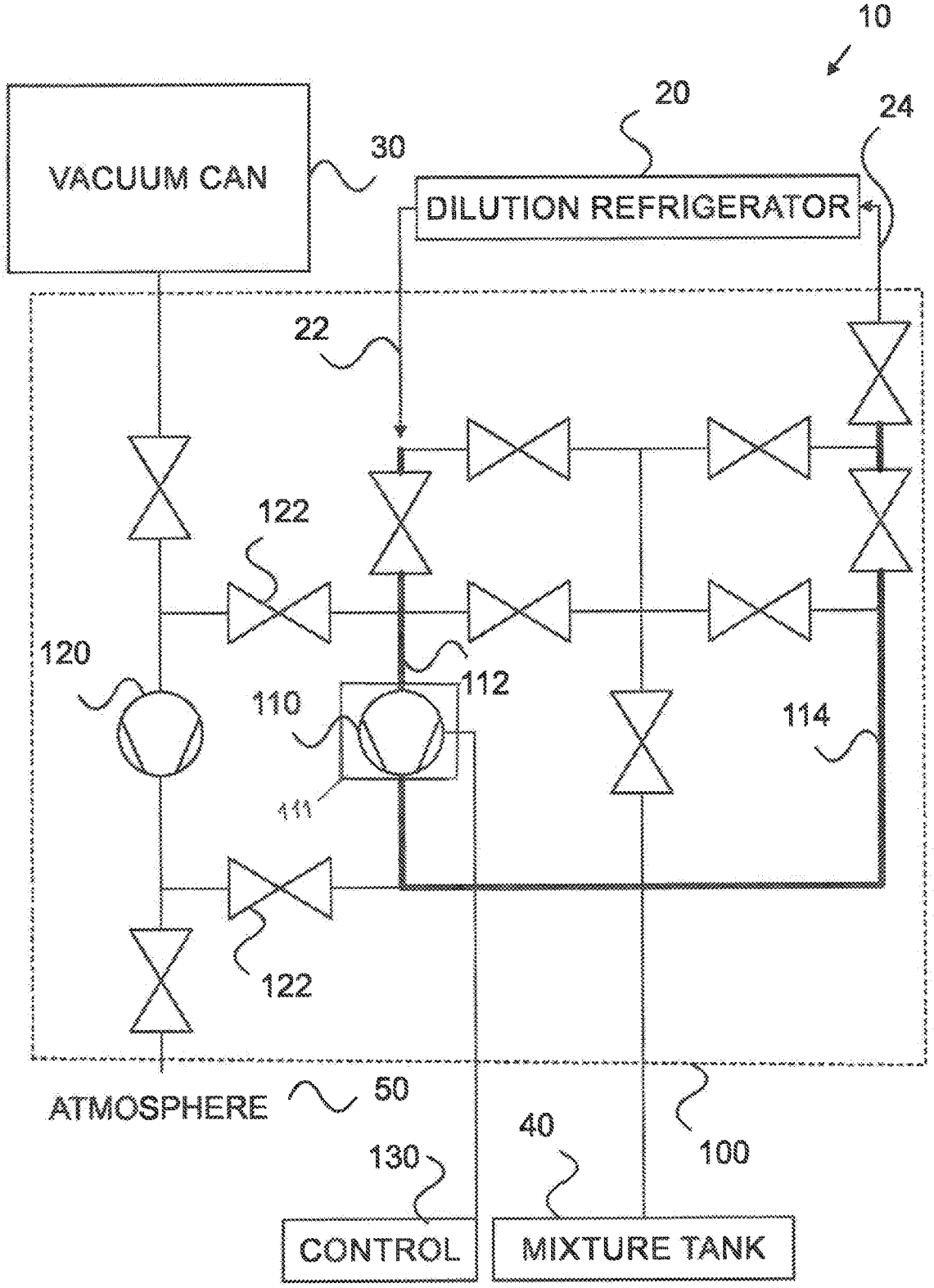
FIG. 1 schematically illustrates a cryogenic cooling system and a gas handling system according to an example.

FIG. 1 shows an example of a cryogenic cooling system 10 and a gas handling system (GHS) 100. The cryogenic cooling system may comprise one or more dilution refrigerators 20 (herein also "the dilution refrigerators"), such as He-3/He-4 dilution refrigerators. The dilution refrigerators may also be referred as dilution units. The GHS can be connected to the dilution refrigerators for circulating helium, in particular He-3 but this can also include He-4, through the dilution refrigerators. While the GHS can be considered to circulate gas through the dilution refrigerators, it should be understood that the helium at the dilution refrigerators can also assume a liquid state as the dilution refrigerators are cooled.

The dilution refrigerators 20 may each comprise an operation space, such as experimental space, for receiving one or more devices to be cooled, and a mixing chamber for cooling the operation space, e.g. by mixing He-3 and He-4. The dilution refrigerators 20 may each further comprise a still chamber for receiving helium from the mixing chamber and evaporating helium vapor from said helium. While the helium from the mixing chamber and the helium vapor may comprise both He-3 and He-4, the helium vapor may mostly consist of He-3. The dilution refrigerators 20 may each comprise various other units, such as heat exchangers, but these are not described here further as the present solution may be used with any range of different types of dilution refrigerators available to a person skilled in the art of dilution refrigeration. The dilution refrigerators may comprise or consist of wet (i.e. cryogen-consuming) dilution refrigerators and/or dry (i.e. cryogen-free) dilution refrigerators, for example.

The GHS 100 may be provided separately from the dilution refrigerators 20 or as integrated with the dilution refrigerators 20. The GHS is arranged to be coupled to the dilution refrigerators to cause helium, in particular He-3, to be circulated through the dilution refrigerators for cooling the dilution refrigerators to a cooled operating temperature, which may be a fraction of one Kelvin, for example 1-100 mK or even less in anticipated solutions. The GHS may be arranged to run closed helium circulation, including He-3 circulation in particular, through the dilution refrigerators for cooling the dilution refrigerators, e.g. by cooling their mixing chambers and thereby their operation chambers, in particular. The cryogenic cooling system 10 may comprise one or more of the GHS 100. Each of the GHS may be arranged to facilitate cooling of one or more dilution refrigerators by helium circulation.

The GHS 100 may comprise a primary pump unit 110 arranged for maintaining both a helium output flow 22, comprising or consisting of helium vapor, from the dilution refrigerators 20 and a helium input flow 24, which may still be in gaseous form, into the dilution refrigerators 20, thereby circulating helium through the dilution refrigerators for cooling the dilution refrigerators (or the mixing chamber of the dilution refrigerators and thereby the operation chamber of the dilution refrigerators in particular). This may be referred herein as "the helium circulation". Herein "cooling" may be understood as maintaining and/or lowering the cooled operating temperature of the dilution refrigerators 20. The primary pump unit 110 may be arranged to circulate helium through the dilution refrigerators in a closed circulation. The GHS, and the primary pump unit, may be arranged to circulate helium, in particular He-3, repeatedly through the dilution refrigerators. This circulation may be continuous. As various methods of providing such circulated cooling are known to a person skilled in the art of dilution refrigeration, these are not described here in further detail. The GHS may comprise one or more pumps, pumping lines (illustrated in FIG. 1 as lines between elements), valves (illustrated in FIG. 1 as hourglass shapes), sensors (e.g. pressure gauges), and so on for the helium circulation. For example, the GHS may comprise one or more still pumping lines 112 of the GHS for receiving the helium vapor from the dilution refrigerators (e.g. at least one still pumping line of the GHS for each of the dilution refrigerators so that the total number of still pumping lines of the GHS is equal or higher to the number of the dilution refrigerators). Similarly, the GHS may comprise an inlet line 114 for providing the helium vapor to the dilution refrigerators (e.g. at least one inlet line for each of the dilution refrigerators). By the helium circulation, the GHS and the primary pump unit in particular, allow cooling the dilution refrigerators to the cooled operating temperature and maintaining the cooled operating temperature of the dilution refrigerator. The still pumping line(s) and/or the inlet line may be arranged to be connected to the primary pump unit 110. Any or all of the one or more still pumping lines may extend to the dilution refrigerators so that said still pumping line(s) may be considered to be situated partially at the GHS and partially at the corresponding dilution refrigerator for capturing helium vapor from said dilution refrigerator, or from the still thereof in particular.

The primary pump unit 110 is additionally arranged for facilitating initiating the helium input flow and the helium output flow (herein also "helium flows") for cooling the dilution refrigerator. It therefore is not restricted to maintaining or increasing already initiated helium flows but the same primary pump unit that maintains the helium flows is also arranged so that it can be used to initiate them. In the GHS as described, the helium flows 22, 24 need therefore not be initially (i.e. when the helium circulation is started) routed through one or more auxiliary systems to get the helium circulation going but they can be directly routed through the primary pump unit 110. This can be achieved by the GHS 100, where the primary pump unit is arranged to both capture the helium vapor of the helium output flow 22 from the dilution refrigerators and cause the helium vapor to be condensed for the helium input flow 24 at the dilution refrigerators. No separate pump units such as turbo pumps and scroll pumps are therefore needed for capturing the helium vapor and maintaining the helium circulation and no separate compressors are needed for condensing the helium vapor, in particular to initiate the helium circulation.

The GHS 100 may thus be arranged to facilitate, by the primary pump unit 110, initiating and/or maintaining a helium input flow 24 into each of the dilution refrigerators 20 and a helium output flow 22 comprising helium vapor from each of the dilution refrigerators for cooling the dilution refrigerators by both capturing the helium vapor from the corresponding dilution refrigerator of the dilution refrigerators and causing the helium vapor to be condensed for the helium input flow at the corresponding dilution refrigerator of the dilution refrigerators.

The primary pump unit 110 may comprise or consist of one or more pumps. It may be formed of a single pump unit of one or more pumps. It may thus be provided as an integrated pump unit, i.e. as a single integrated system/unit. In particular, the primary pump unit is arranged to function by pumping so that compression (by a compressor) is no longer needed for condensing the helium vapor, in particular to initiate the helium circulation.

The primary pump unit 110 may have a housing 111 that forms an outer surface of the primary pump unit. The outer surface may enclose all the pumps (one or more) of the primary pump unit. The housing may thus form an enclosing surface for the primary pump unit, for example as a fully enclosing surface. The enclosing surface may be a cuboid, such as a rectangular cuboid or a cube. It should be understood that the enclosing surface may have rounded and/or sharp corners. The housing of the primary pump unit is a dedicated housing for the primary pump unit, in contrast to an optionally provided housing of the GHS which can house multiple components, including the primary pump unit. When the number of pumps of the primary pump unit is two or more, each of the pumps of the primary pump unit may be devoid of a single-pump housing (i.e. a housing dedicated only for a single pump), only to be covered by said housing of the primary pump unit. All the pumps of the primary pump unit can be jointly housed in the housing of the primary pump unit, i.e. within a single housing which is the housing of the primary pump unit. In general, the housing can thus be formed as a common housing of the primary pump unit. The housing may also be understood as the innermost housing for each of the pumps of the primary pump unit. The innermost housing covering any one of the pumps of the primary pump unit can thus be the housing that covers all of the pumps of the primary pump unit, thereby providing one integrating housing for the primary pump unit. The GHS may still have one or more housings enclosing the housing of the primary pump unit. These can then enclose one or more other components of the GHS in addition to the primary pump unit, such as one or more auxiliary pump units 120, as described below, and/or one or more pumping lines. The one or more housings enclosing the housing of the primary pump unit may also enclose any or all of the following for the primary pump unit, or the GHS and/or the dilution refrigerators in general: monitoring and/or control electronics, one or more diagnostic systems, a user interface optionally including one or more displays, a connectivity system, one or more circuit brakers, one or more valve position readouts and a UPS (uninterruptible power supply) system. The housing of the primary pump unit may comprise one or more outlets, as an external connection outlet, for connecting to any or all of the above-mentioned components, such as the monitoring and/or control electronics for the primary pump unit.

The one or more pumps of the primary pump unit 110 as mentioned above may be Roots pumps, such as single-stage Roots pumps (SSR) and/or multi-stage Roots pumps (MSR). Such Roots pumps may be formed as rotary pumps, which may be of positive-displacement type. Each stage of such a Roots pump may have a pair of impellers, which may be shaped symmetrically, arranged to rotate so the blades of the impellers alternatingly share the same space. For multi-stage Roots pumps, multiple such pairs of impellers may be arranged in cascade, where the number of the pairs may thus be understood as the number of the pumping stages. When any MSR is used, it may have more than two pumping stages, in particular five or more pumping stages. The Roots pumps may be arranged for facilitating initiating the helium input flow and the helium output flow by both capturing the helium vapor from the dilution refrigerators and causing the helium vapor to be condensed. The GHS may, in particular with the Roots pumps used as the one or more pumps of the primary pump unit 110, be arranged to increase the helium input flow and/or the helium output flow into the dilution refrigerators to 2 mmol/s or more, e.g. above 5 mmol/s or 20 mmol/s, with the primary pump unit.

Specifically, the primary pump unit 110 may comprise or consist of a single-stage Roots pump and a multi-stage Roots pump, where the single-stage Roots pump may be arranged upstream of the multi-stage Roots pump (i.e. SSR on the side of the helium output flow and MSR on the side of the helium input flow). MSR(s) may thus be integrated with SSR(s) in the primary pump unit. The impeller support of the SSR(s) can be larger than the impeller support for the MSR(s), thereby allowing the SSR to have a larger volume to handle helium flow through the pump than the MSR. An upstream SSR can therefore be arranged to receive the initial impact of pressure increase from the helium flow and thereby improve the performance of the primary pump unit.

While the primary pump unit 110 may include only a single pump, such as a single multi-stage roots pump, or a single SSR-MSR-pair as described above, an alternative is to have the primary pump unit comprise at least two pumps, such as multi-stage Roots pumps according to any of the examples described above, in parallel for facilitating initiating the helium input flow and the helium output flow for cooling the dilution refrigerators and/or maintaining the helium input flow and the helium output flow for maintaining the helium circulation. The at least two pumps may be arranged to capture the helium vapor in parallel. The at least two pumps in parallel may still be preceded by one or more pumps arranged upstream of them, for example a single pump, such as a SSR, whose output is split into the at least two pumps in parallel or multiple pumps, such as SSRs, in parallel. In the latter case, the number each of the at least two pumps may have their own preceding pump.

The cryogenic cooling system 10 may comprise one or more vacuum cans 30 for vacuum isolation of each of the dilution refrigerators from surrounding environment and/or one or more tanks 40, such as mixture tanks, for storing helium for the helium circulation. The GHS 100 may be coupled to the vacuum can(s) for providing the vacuum isolation. This can be done through one or more valves. The GHS may be coupled to the tank(s) for receiving helium, or He-3/He-4 mixture in particular, from the tank(s) for the helium circulation and/or storing helium into the tank(s) after the helium circulation. This can also be done through one or more valves. The GHS may also have an outlet 50 for gas release. This can also take place through one or more valves. The primary pump unit 110 may be arranged to facilitate initiating the helium circulation by drawing the helium from the tank(s) 40. One or more bypass valves may be placed on the input end and/or the output end of the dilution refrigerator (where pressure is likely to be highest with blockage).

The GHS 100 may further comprise one or more auxiliary pump units 120 (herein also "the auxiliary pump units"). These maybe arranged to function as system pumps, which can be arranged to handle various general tasks of the GHS, such as emptying the vacuum can(s) 30 and/or any pumping lines before the primary pump unit is started. They can also be arranged to return helium to the tank(s) 40. For this purpose, the auxiliary pump units may be connected to the outlet 50 for gas release. With the present solution, the auxiliary pump units are nevertheless not needed for initiating the helium circulation. However, they may be separable from the primary pump unit 110 through one or more valves 122, allowing them to support and/or replace the function of the primary pump unit for the helium circulation. In particular, the auxiliary pump unit 120 may comprise one or more multi-stage Roots pumps for maintaining the helium output flow and the helium input flow for maintaining the cooled operating temperature of the dilution refrigerators 20 when the helium vapor is routed through the auxiliary pump unit through the one or more valves 122. The auxiliary pump unit 120, in particular with a multi-stage Roots pump, can thus be utilized as a backup circulation pump to maintain the cooled operating temperature of the dilution refrigerators 20.

The GHS may also comprise or be arranged to be connected, e.g. by a control interface, to a control system 130 for adjusting a rotation rate of any or all of the one or more pumps of the primary pump unit 110. The control system may comprise one or more microcontrollers and/or microprocessors. It may comprise one or more displays and/or one or more input interfaces such as touch screens and/or keyboards.

With the present solution, the GHS 100 can be arranged to circulate helium from the helium output flow to the helium input flow without purification. Helium can thus be directly circulated from the dilution refrigerators 20 (in particular from the helium output flow) to the primary pump unit 110 and/or from the primary pump unit to the dilution refrigerators (in particular to the helium input flow) without subjecting it to traps, which are constructions typically used for purification of the helium from impurities.

The housing of the primary pump unit and/or the dilution refrigerators may have seals such as rubber seals, e.g. rubber O-rings, and/or metal seals. In particular when the GHS is provided without traps, metal seals may be used for the housing and/or the dilution refrigerators.

Figure 2:
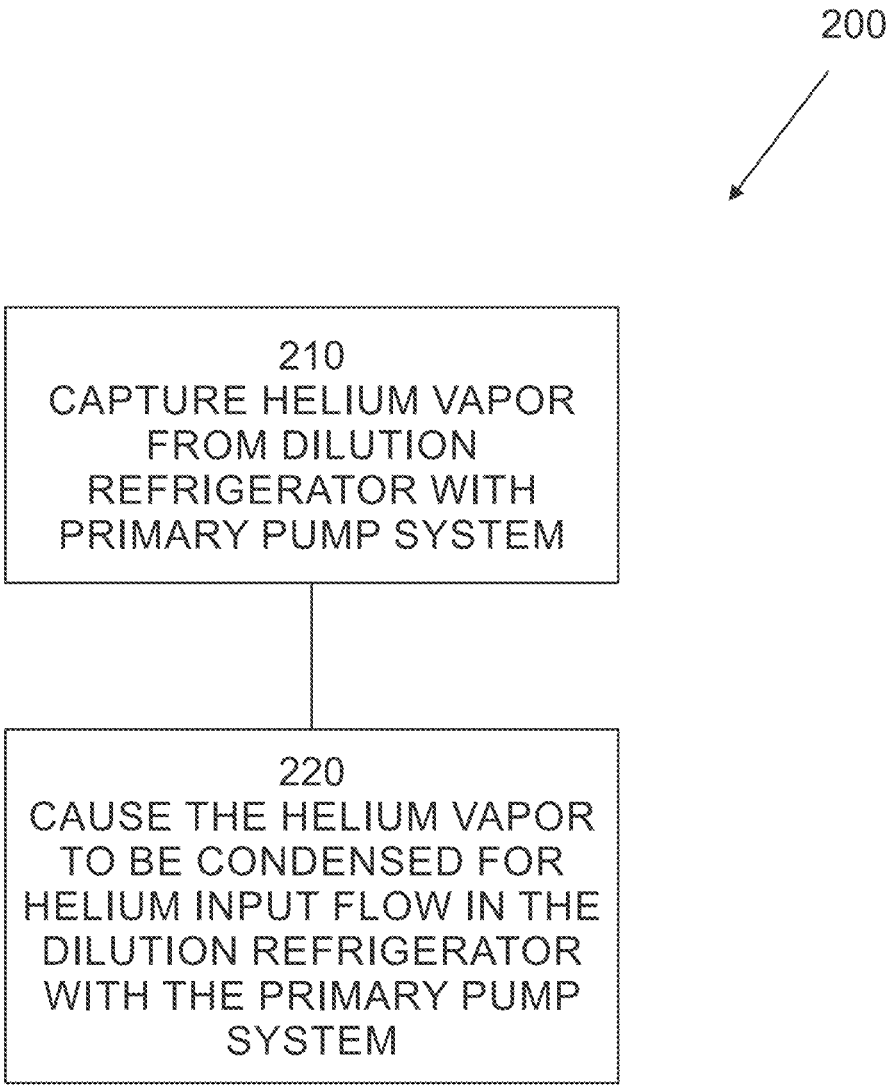
FIG. 2 illustrates a method according to an example.

FIG. 2 shows an example of a method 200 for gas handling for one or more dilution refrigerators 20, e.g. as disclosed herein. The method comprises several parts which may be performed independently from each other and/or in any order. The method comprising facilitating a helium input flow 24 into the one or more dilution refrigerators 20 and a helium output flow 22 comprising helium vapor from the one or more dilution refrigerators 20 for cooling the one or more dilution refrigerators by, with a primary pump unit, both capturing 210 the helium vapor from the one or more dilution refrigerators and causing 220 the helium vapor to be condensed for the helium input flow at the one or more dilution refrigerators. The method may also comprise initiating and/or maintaining the helium input flow and the helium output flow using the primary pump unit. Thus, the method may comprise providing the helium circulation with the primary pump unit. Any of the examples described above may be utilized in connection with the method.

The different functions discussed herein may be performed in a different order and/or concurrently with each other.

Although the subject matter has been de-scribed in language specific to structural features and/or acts, it is to be understood that the subject matter for which protection is sought is defined in the appended claims and not necessarily limited to the specific features or acts described above. Any example disclosed herein may be combined with another example unless explicitly disallowed.

The term 'comprising' is used herein to mean including the method, blocks or elements identified, but that such blocks or elements do not comprise an exclusive list and a method or apparatus may contain additional blocks or elements.

Numerical descriptors such as 'first', 'second', and the like are used in this text simply as a way of differentiating between parts that otherwise have similar names. The numerical descriptors are not to be construed as indicating any particular order, such as an order of preference, manufacture, or occurrence in any particular structure.

Expressions such as 'plurality' are in this text to indicate that the entities referred thereby are in plural, i.e. the number of the entities is two or more.

The invention claimed is:

1. A gas handling system (GHS) for a dilution refrigerator, the GHS comprising a primary pump unit arranged for maintaining a helium output flow comprising helium vapor from the dilution refrigerator and a helium input flow into the dilution refrigerator for maintaining a cooled operating temperature of the dilution refrigerator;

wherein the primary pump unit is arranged for facilitating initiating the helium input flow and the helium output flow for cooling the dilution refrigerator by both capturing the helium vapor from the dilution refrigerator and causing the helium vapor to be condensed for the helium input flow at the dilution refrigerator;

wherein the primary pump unit consists of one or more Roots pumps arranged for facilitating initiating the helium input flow and the helium output flow by both capturing the helium vapor from the dilution refrigerator and causing the helium vapor to be condensed;

wherein the one or more Roots pumps comprises a multi-stage Roots pump and a single-stage Roots pump arranged upstream of the multi-stage Roots pump.

2. The GHS according to claim 1, wherein the primary pump unit comprises a housing that forms an outer surface of the primary pump unit.

3. The GHS according to claim 1, wherein the multi-stage Roots pump comprises five or more pumping stages.

4. The GHS according to claim 1, further comprising an auxiliary pump unit separable from the primary pump unit through one or more valves, the auxiliary pump unit comprising one or more multi-stage Roots pumps for maintaining the helium output flow and the helium input flow for maintaining the cooled operating temperature of the dilution refrigerator when the helium vapor is routed through the auxiliary pump unit through the one or more valves.

5. The GHS according to claim 1, further comprising a control system for adjusting a rotation rate of the one or more Roots pumps of the primary pump unit.

6. The GHS according to claim 1, wherein the GHS is arranged to circulate helium from the helium output flow to the helium input flow without purification.

7. The GHS according to claim 1, wherein the GHS is arranged to increase the helium input flow into the dilution refrigerator to 2 mmol/s or more with the primary pump unit.

8. The GHS according to claim 1, wherein the primary pump unit comprises at least two pumps in parallel for facilitating initiating the helium input flow and the helium output flow for cooling the dilution refrigerator, the at least two pumps capturing the helium vapor in parallel.

9. The GHS according to claim 8, wherein the at least two pumps in parallel are multi-stage Roots pumps.

10. The GHS according to claim 1, wherein the capturing the helium vapor from the dilution refrigerator is performed at a pressure of 0,3 mbar or less for a molar flow of 2 mmol/s or more.

11. The GHS according to claim 1, wherein the GHS is arranged to provide an output pressure of 0,5 bar or more for the helium vapor to cause the helium vapor to be condensed for the helium input flow at the dilution refrigerator.

12. A cryogenic cooling system comprising:

one or more dilution refrigerators; and a gas handling system (GHS) for the one or more dilution refrigerators, the GHS comprising a primary pump unit arranged for maintaining a helium output flow comprising helium vapor from the one or more dilution refrigerators and a helium input flow into the one or more dilution refrigerators for maintaining a cooled operating temperature of the one or more dilution refrigerators;

wherein the primary pump unit consists of one or more Roots pumps;

wherein the one or more Roots pumps comprises a multi-stage Roots pump and a single-stage Roots pump arranged upstream of the multi-stage Roots pump; and wherein the gas handling system being arranged to facilitate, by the primary pump unit, initiating a helium input flow into each of the one or more dilution refrigerators and a helium output flow comprising helium vapor from each of the one or more dilution refrigerators for cooling the one or more dilution refrigerators by both capturing the helium vapor from a corresponding dilution refrigerator of the one or more dilution refrigerators and causing the helium vapor to be condensed for the helium input flow at the corresponding dilution refrigerator of the one or more dilution refrigerators.

13. A method for gas handling for a dilution refrigerator, the method comprising:

facilitating a helium input flow into the dilution refrigerator and a helium output flow comprising helium vapor from the dilution refrigerator for cooling the dilution refrigerator by both capturing the helium vapor from the dilution refrigerator and causing the helium vapor to be condensed for the helium input flow at the dilution refrigerator with a primary pump unit;

providing the primary pump unit consisting of one or more Roots pumps arranged for facilitating initiating the helium input flow and the helium output flow by both capturing the helium vapor from the dilution refrigerator and causing the helium vapor to be condensed;

wherein the one or more Roots pumps comprises a multi-stage Roots pump and a single-stage Roots pump arranged upstream of the multi-stage Roots pump.

14. The GHS according to claim 1, wherein the one or more Roots pumps consists of a multi-stage Roots pump and a single-stage Roots pump arranged upstream of the multi-stage Roots pump.

15. The cryogenic cooling system according to claim 12, wherein the one or more Roots pumps consists of a multi-stage Roots pump and a single-stage Roots pump arranged upstream of the multi-stage Roots pump.

16. The method for gas handling for a dilution refrigerator according to claim 13, wherein the one or more Roots pumps consists of a multi-stage Roots pump and a single-stage Roots pump arranged upstream of the multi-stage Roots pump.

* * * * *